US009609951B2

(12) United States Patent
Chan

(10) Patent No.: US 9,609,951 B2
(45) Date of Patent: Apr. 4, 2017

(54) FOAM SEAT CUSHIONS

(71) Applicant: King Chan, Lake Oswego, OR (US)

(72) Inventor: King Chan, Lake Oswego, OR (US)

( * ) Notice: Subject to any disclaimer, the term of this patent is extended or adjusted under 35 U.S.C. 154(b) by 0 days.

(21) Appl. No.: 14/844,976

(22) Filed: Sep. 3, 2015

(65) Prior Publication Data

US 2017/0065085 A1 Mar. 9, 2017

(51) Int. Cl.

| | |
|---|---|
| ***A47C 7/02*** | (2006.01) |
| ***A47C 7/18*** | (2006.01) |
| ***A47C 7/22*** | (2006.01) |
| ***A47C 7/74*** | (2006.01) |
| ***A47C 7/35*** | (2006.01) |
| ***A47C 4/00*** | (2006.01) |

(52) U.S. Cl.

CPC ..... *A47C 7/22* (2013.01); *A47C 4/00* (2013.01); *A47C 7/021* (2013.01); *A47C 7/022* (2013.01); *A47C 7/18* (2013.01); *A47C 7/35* (2013.01); *A47C 7/746* (2013.01)

(58) Field of Classification Search

CPC ..... A47C 7/02; A47C 7/021; A47C 7/022
USPC ..... 297/452.22, 452.23, 452.25, 452.26, 297/180.11, 183.1, 183.6, 219.1, 228.13, 297/452.21

See application file for complete search history.

(56) References Cited

U.S. PATENT DOCUMENTS

| | | | | | |
|---|---|---|---|---|---|
| 859,828 | A * | 7/1907 | McCloud | A47C 7/022 | 297/452.22 |
| 2,199,479 | A * | 5/1940 | Cappel | A61M 16/06 | 297/452.22 X |
| 2,412,112 | A * | 12/1946 | Wood | A47C 7/022 | 297/452.26 |
| 3,376,070 | A * | 4/1968 | Johnson | A47C 7/022 | 297/452.26 X |
| 4,588,229 | A * | 5/1986 | Jay | A47C 7/021 | 297/452.23 X |
| 4,726,624 | A * | 2/1988 | Jay | A47C 7/021 | 297/452.23 |
| 4,824,169 | A * | 4/1989 | Jarrell | A47C 7/022 | 297/452.26 X |
| 4,824,174 | A * | 4/1989 | Dunn, Sr. | A47C 7/022 | 297/452.22 |
| 5,522,106 | A * | 6/1996 | Harrison | A47C 7/022 | 297/452.25 |
| 5,681,092 | A * | 10/1997 | Hanson | A61G 5/1043 | 297/452.22 X |
| 6,082,824 | A * | 7/2000 | Chow | A47C 7/022 | 297/452.22 |

(Continued)

FOREIGN PATENT DOCUMENTS

| | | | | |
|---|---|---|---|---|
| DE | 4300602 A1 * | 7/1994 | A47C 7/022 | |
| GB | 2052965 A * | 2/1981 | A47C 7/425 | |
| WO | WO 8607528 A1 * | 12/1986 | A47C 7/022 | |

*Primary Examiner* — Rodney B White
(74) *Attorney, Agent, or Firm* — Mohr Intellectual Property Law Solutions, PC

(57) ABSTRACT

Improved foam seat cushions that are ergonomically shaped, equipped with a notch to facilitate proper sitting and to potentially center on a seat, and a plurality of channels running through the cushion to provide cooling. In some examples, the foam seat cushion includes handles located on either side and can be folded in half for easy transport. In some further examples, the foam seat cushion includes a cushioning layer disposed at the foam layer.

16 Claims, 5 Drawing Sheets

(56) References Cited

U.S. PATENT DOCUMENTS 6,241,320 B1 * 6/2001 Chew ..... A47C 7/021 297/452.26
6,625,830 B2 * 9/2003 Lampel ..... A47C 27/146 297/452.26
6,687,934 B1 * 2/2004 Liao ..... A47C 7/14 297/452.26 X
7,024,714 B1 * 4/2006 Yates ..... A47C 7/022 297/452.23
7,044,547 B2 * 5/2006 Sorrenti ..... A47C 3/16 297/452.25 X
7,140,057 B2 * 11/2006 Hetzel ..... A47C 7/022 297/452.26
7,373,678 B2 * 5/2008 Hetzel ..... A47C 7/022 297/452.26 X
7,694,788 B2 * 4/2010 Hann ..... B25H 3/02 297/219.1 X
7,819,484 B2 * 10/2010 Conforti ..... A47C 7/62 297/219.1
8,220,873 B2 * 7/2012 Kemp ..... A47C 7/021 297/452.23 X
8,850,645 B1 * 10/2014 Jackson ..... A47C 4/52 297/452.23
9,220,345 B2 * 12/2015 Davis ..... A47C 7/62
9,332,850 B2 * 5/2016 Krishtul ..... A47C 7/022
2002/0175553 A1 * 11/2002 Steifensand ..... A47C 3/00 297/452.22
2004/0155506 A1 * 8/2004 Gentry ..... A47C 7/748 297/180.11 X
2005/0200187 A1 * 9/2005 Vela-Cobos ..... A47C 7/022 297/452.22
2007/0096523 A1 * 5/2007 Greene ..... A47C 7/024 297/452.26 X
2008/0244832 A1 * 10/2008 Kuo ..... A47C 7/021 297/180.11 X
2010/0327639 A1 * 12/2010 Peters ..... A47C 7/00 297/183.1
2015/0313782 A1 * 11/2015 Mulholland ..... A61G 5/12 297/183.1 X
2016/0166063 A1 * 6/2016 Siekman ..... A47C 7/021 297/452.26

* cited by examiner

FOAM SEAT CUSHIONS

BACKGROUND

The present disclosure relates generally to seat cushions. In particular, ergonomically shaped foam cushions with improved comfort and cooling are described.

Known seat cushions are not entirely satisfactory for the range of applications in which they are employed. For example, existing seat cushions may be too thin, or made from materials that trap heat and moisture, thereby diminishing the level of comfort for the user. Most seat cushions provided on chairs if provided at all) are not ergonomically shaped to conform to the user's contours, potentially creating pressure points. Furthermore, for those chairs that do have a relatively comfortable cushion, they frequently are permanently fixed as part of the chair, and cannot be transported for use on seats that lack proper cushioning.

Thus, there exists a need for improved foam seat cushions that improve upon and advance the design of known foam seat cushions. Examples of new and useful foam seat cushions relevant to the needs existing in the field are discussed below.

SUMMARY

The present disclosure is directed to an improved foam seat cushion that is ergonomically shaped, equipped with a notch to facilitate proper sitting and to potentially center on a seat, and a plurality of channels running through the cushion to provide cooling. In some examples, the foam seat cushion includes handles located on either side and can be folded in half for easy transport. In some further examples, the foam seat cushion includes a cushioning layer disposed atop the foam layer.

DETAILED DESCRIPTION

The disclosed improved foam seat cushions will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various improved foam seat cushions are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Figure 1:
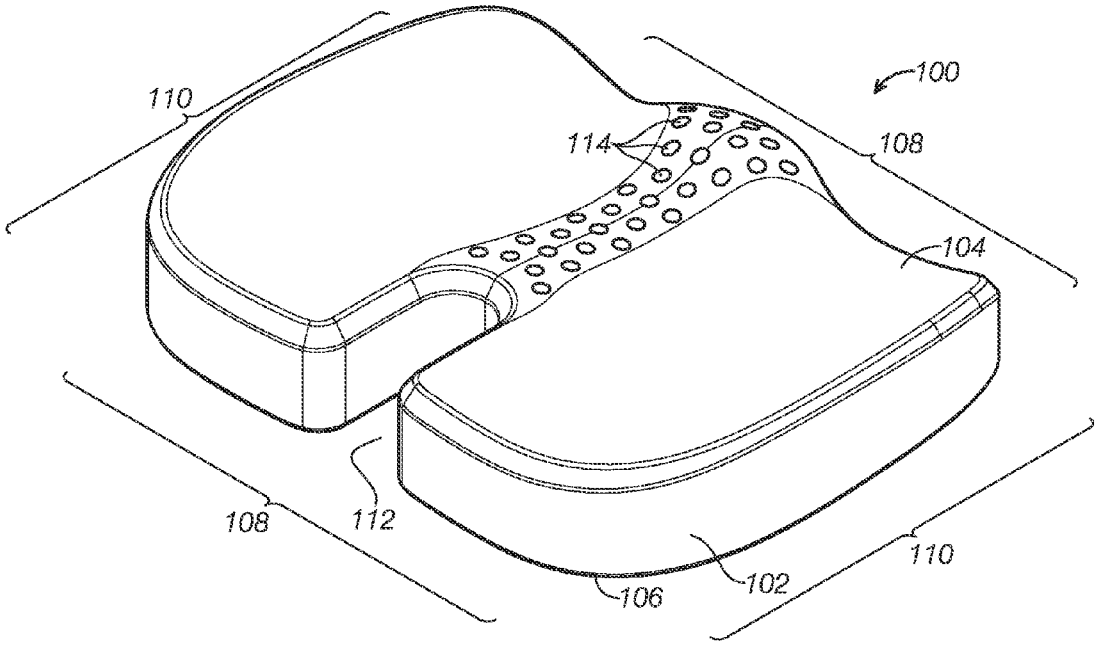
FIG. 1 is a perspective view of a first example of an improved foam seat cushion.
Figure 2:
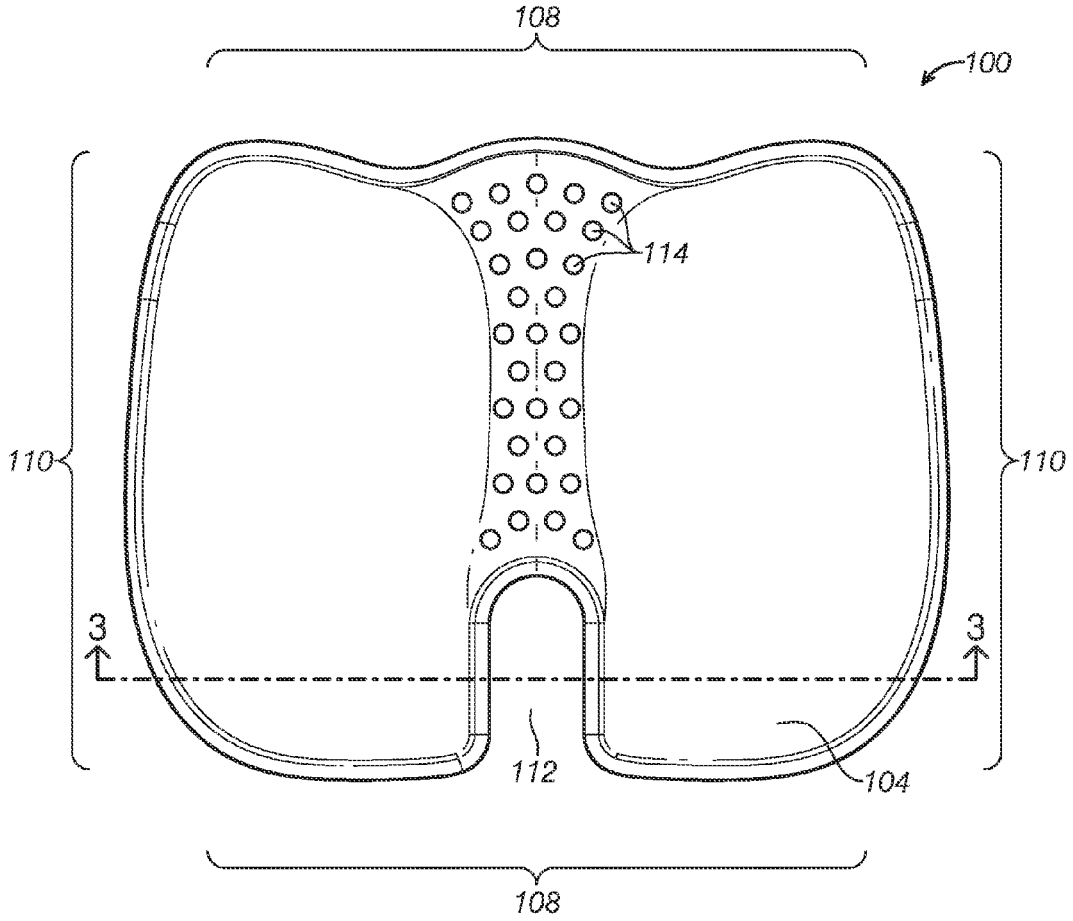
FIG. 2 is an overhead view of the improved foam seat cushion shown in FIG. 1 depicting the general layout of the channels and the notch.
Figure 3:
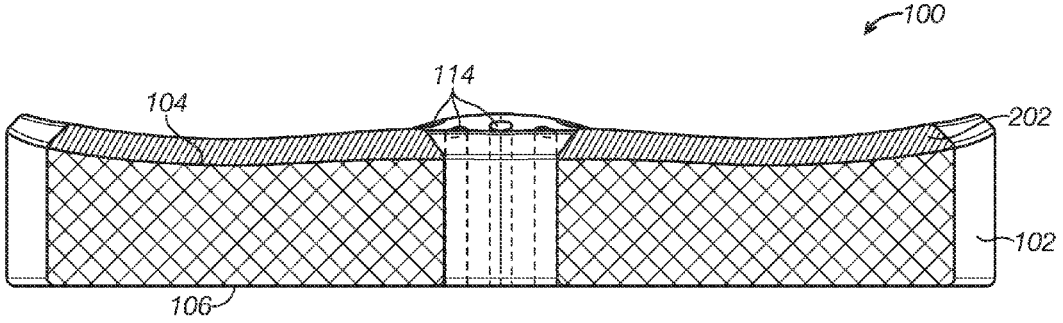
FIG. 3 is a cross-sectional view of section AA of the improved foam seat cushion shown in FIG. 2, depicting the angle of the notch to the top surface of the cushion, and a cross section of a pair of channels.

With reference to FIGS. 1-3, a first example of an improved foam seat cushion, foam seat cushion 100, will now be described. Foam seat cushion 100 functions to provide a general seat cushion that offers superior support and comfort as compared to conventional seating cushions, and can be used either as a stand-alone cushion, to add cushioning to a seat that lacks an existing pad or cushion, or to supplement padding on a seat. The reader will appreciate from the figures and description below that foam seat cushion 100 addresses shortcomings of conventional seat cushions.

For example, foam seat cushion 100 is ergonomically shaped to conform to the curves of its user, so as to minimize pressure points. Foam seat cushion 100 includes a notch to provide a tactile guide to the user to sit centrally over the cushion, to maximize comfort. Further, by employing a plurality of channels that pass through the foam layer, foam seat cushion 100 provides a cooler experience for the user by allowing air to circulate and moisture to be dissipated, instead of trapping heat and moisture next to an impermeable layer.

Foam seat cushion 100 is comprised of a foam layer 102, which possesses CA top surface 104, a bottom surface 106, a plurality of first sides 108 and a plurality of second sides 110. Cutting into the approximately the middle of one of the first sides 108 is located a notch 112, which runs between the top surface 104 and bottom surface 106 of foam layer 102, extending from the first side 108 towards the center of the foam layer so as to partially bisect the foam layer. A plurality of channels 114 run through foam layer 102, each opening on the top surface 104 and bottom surface 106, thus passing through the foam layer 102.

As can be seen in FIGS. 1 and 2 foam layer 102 is preferably contoured so as to receive the posterior of a user. Generally and as shown in the figures, foam layer 102 is preferably shaped with a pair of symmetrically mirrored central depressions, separated by a central rise, to accommodate the user's legs and posterior. This shape maximizes the even distribution of the user's weight across the cushion and helps to center the user over the cushion, to ensure optimal comfort. Dimensionally, foam layer 102 is typically roughly rectangular, with rounded edges and corners, and the first side 108 opposite notch 112 preferably possessing a scalloped shape to better conform to the legs of the user. Foam layer 102 can, however, be shaped in a more rounded form, or polygonally.

With respect to length and width dimensions, foam layer 102 is sized roughly similar to most seats commonly available, and can further be sized in varying dimensions to accommodate a variety of users. For example, a small dimensioned foam layer 102 may be provided where the intended user is a child. A slightly larger dimensioned foam layer 102 could accommodate an older child, and an average sized layer can accommodate most adults. A large dimension foam layer 102 can accommodate larger adults. Likewise, the thickness of foam layer 102 should be selected with respect to the desired amount of padding and intended user and purpose, with further consideration given to the type of foam. Foam seat cushions 100 intended for use over preexisting padding can be made with a thinner foam layer 102 as compared to foam seat cushions 100 intended for use over a hard surface while achieving comparable levels of comfort. Similarly, foam seat cushions 100 intended for use with children will not require as thick a foam layer 102 as foam seat cushions 100 intended for use with adults to achieve comparable comfort levels.

Foam layer 102 is preferably constructed from sturdy foam that is capable of absorbing the weight of the typical user. Such types of foams can include dense closed-cell foams, open cell foams, viscoelastic urethane foams (commonly known as memory foam), foam rubbers, or any other elastic material suitable for a weight-bearing cushion. Further, the material used to construct foam layer 102 can be selected with consideration given to the degree of cushioning desired. A denser foam will yield a firmer support, while using a more lightweight, yielding foam will provide greater cushioning, but with the trade-off of greater give and compression. Such yielding foam may, however, require a thicker layer to achieve comparable support to more dense foam. Foam layer 102 may, depending on the foam used and whether gas-proof or moisture-proof characteristics are desired, possess an exterior membrane or skin wrapping the layer. Furthermore, foam layer 102 can be constructed out of a combination of materials to achieve still further greater variety of firmness and support characteristics. Still further, foam layer 102 could be constructed of non-foam materials such as polyester batting, nylon fill, Styrofoam fill, or other types of loose or fluff materials that are surrounded by a case that provides the seat form once sufficiently filled.

In the example shown in FIGS. 1-3, notch 112 is shown as opening from a first side 108 and extending perpendicular towards the center of foam layer 102, but preferably does not completely bisect foam layer 102. In FIG. 2, notch 112 is shown extending approximately $\frac{1}{3}^{rd}$ of the way into foam layer 102. Notch 112 runs completely vertically through foam layer 102, creating a channel between top surface 104 and bottom surface 106. As shown in FIG. 3, the edge of notch 112 formed where notch 112 opens to top surface 104 is rounded and/or angled. This edge is preferably between the range of 25 degrees to 45 degrees. Notch 112 serves to provide tactile feedback to the user of foam seat cushion 100 to indicate when the user is properly centered on foam seat cushion 100, thereby enhancing comfort in use, and also serves to both provide additional cooling well as to lighten foam seat cushion 100. The size of notch 112 can be varied to adjust comfort; additionally, notch 112 can be sized to as to accept part of a chair structure in some circumstances of use, to keep foam seat cushion 100 centered on a chair upon which it is deployed.

Also depicted in FIGS. 1-3 are a plurality of channels 114. Referring to FIG. 3, it can be seen that each channel 114 runs through foam layer 102 opening upon and connecting together both top surface 104 and bottom surface 106. As described above, channels 114 help facilitate airflow through foam layer 102 to aid in cooling and moisture dissipation. Plurality of channels 114 can be arranged in a variety of patterns to achieve various cooling effects in various parts of foam seat cushion 100. As shown in FIG. 2, channels 114 are arranged in a staggered formation, in a strip that approximately extends across foam layer 102 from the end of notch 112 to the side of first side 108 opposite notch 112.

Depending on the design goals, plurality of channels 114 can be sized homogenously or with varying sizes. By changing the size and configuration of each of plurality of channels 114, different degrees of cooling effect can be obtained. Furthermore, adding channels 114 serves to decrease the resistance of foam layer 102 by virtue of the removal of foam material. Thus, the size and configuration of plurality of channels 114 can be tailored to vary the support and firmness of foam seat cushion 100 in various locations across its surface. Larger channels 114 will provide a greater cooling effect, but also effectively decrease the firmness of foam layer 102 by virtue of less foam material being present. Conversely, smaller channels 114 will provide lower cooling, but retain more of foam layer 102's firmness. Similarly, more channels 114 in a given area will decrease firmness. It will be appreciated by a person skilled in the relevant art that while channels 114 are depicted as round, they can equally be implemented in a variety of shapes without departing from the disclosed invention.

Still further, channels 114 could be arranged so as to run through the center of foam layer 102 to connect plurality of first sides 108 together or plurality of second sides 110 together. In this way, air would flow longitudinally through foam layer 102, and with appropriate placement would be useful for adjusting and tuning the firmness of foam seat cushion 100.

Turning attention to FIG. 3, a second example of an improved foam seat cushion, foam seat cushion 200, will now be described. Foam seat cushion 200 includes many similar or identical features to foam seat cushion 100. Thus, for the sake of brevity, each feature of foam seat cushion 200 will not be redundantly explained. Rather, key distinctions between foam seat cushion 200 and foam seat cushion 100 will be described in detail and the reader should reference the discussion above for features substantially similar between the two foam seat cushions.

Figure 4:
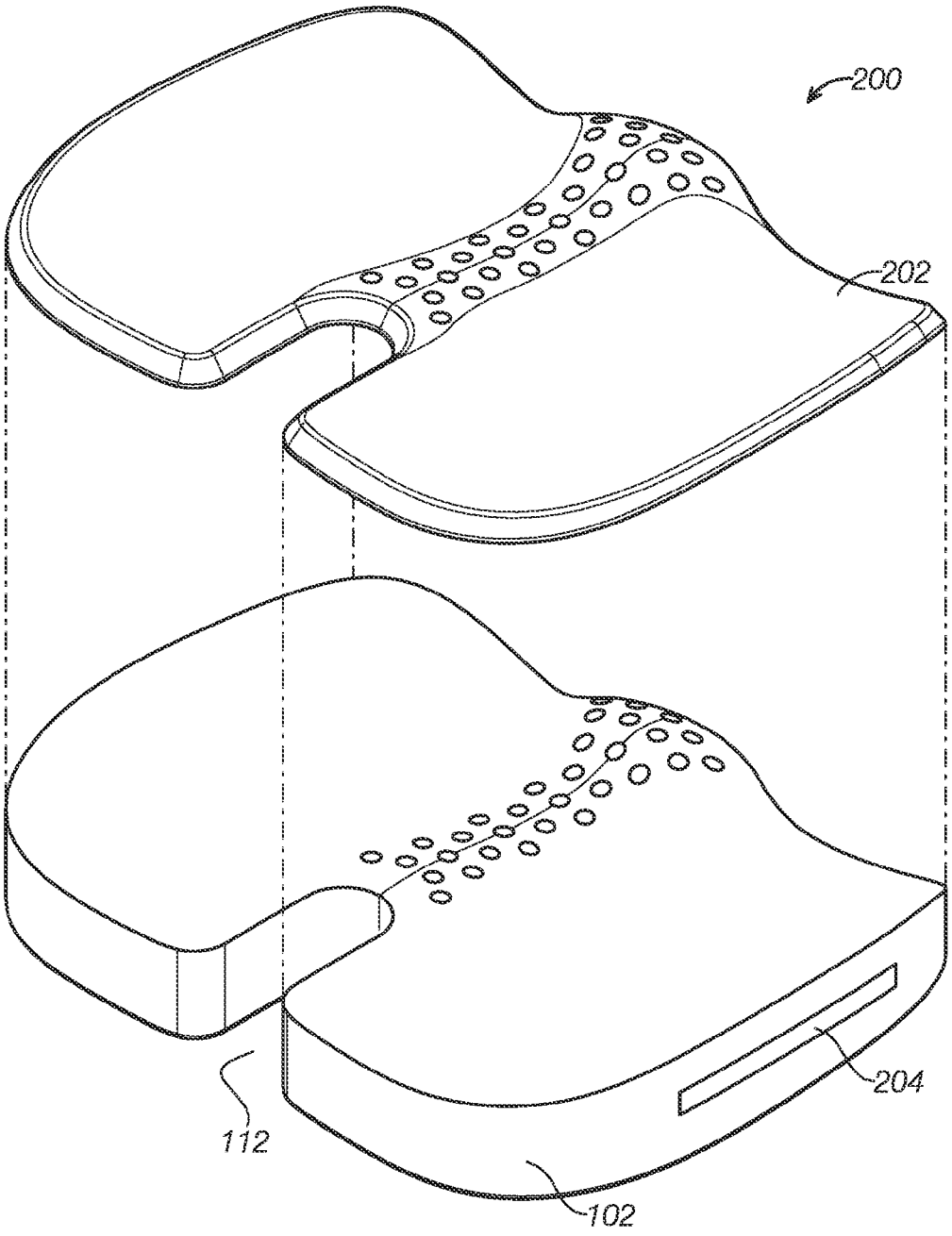
FIG. 4 is an exploded perspective view of a second example of an improved foam seat cushion including an additional gel cushioning layer that is disposed upon the top surface of the cushion.

As can be seen in FIG. 4, foam seat cushion 200 includes a foam layer 102, a notch 112, and channels 114. In addition, foam seat cushion 200 also includes an additional cushioning layer 202, and a plurality of handles 204, one of which is each located on opposing sides of foam layer 102.

Cushioning layer 202, as depicted in FIG. 4, is disposed upon and attached to top surface 104 of foam layer 102. Cushioning layer 202 is preferably constructed from a sandwich gel layer, where a silicone or other similar cushioning gel as known in the art is sandwiched between two impermeable layers. The surface of cushioning layer 202 can be smooth, or equipped with dimples or other patterns to achieve desired feel and comfort. Apertures are provided through cushioning layer 202 to accommodate the plurality of channels 114.

Also seen in FIG. 4 are a plurality of handles 204, which are each attached to a second side 110. Foam layer 102 can be bisected laterally, along the axis of notch 112, with either the bisection being partial, or complete through to cushioning layer 202, which is kept intact, thereby ensuring the two halves of foam layer 102 are kept together. Further still, foam seat cushion 200 can optionally be equipped with an outer form-fitting cover that encloses foam seat cushion 200, made from a flexible material such as fabric, plastic, rubber, vinyl, or other suitable material that can be made to fit around foam seat cushion 200. Where foam seat cushion 200 is equipped with an outer form-fitting cover, both foam layer 102 and cushioning layer 202 can be completely bisected, with the outer form-fitting cover acting to keep the two halves of foam layer 102 and cushioning layer 202 together. This bisection allows foam seat cushion 200 to be folded in half and carried by handles 204 for easy transport. Alternatively, a single handle can be located on foam seat cushion 200 where the size and weight of foam seat cushion 200 do not render it impractical to carry in an unfolded state. It will be understood by a person killed in the relevant art that the outer form-fitting cover either leaves handles 204 exposed, provides a cut-out to expose handles 204, or has handles 204 attached to its exterior, to ensure the user of foam seat cushion 200 can utilize handles 204 while the cover is in place.

Figure 5A:
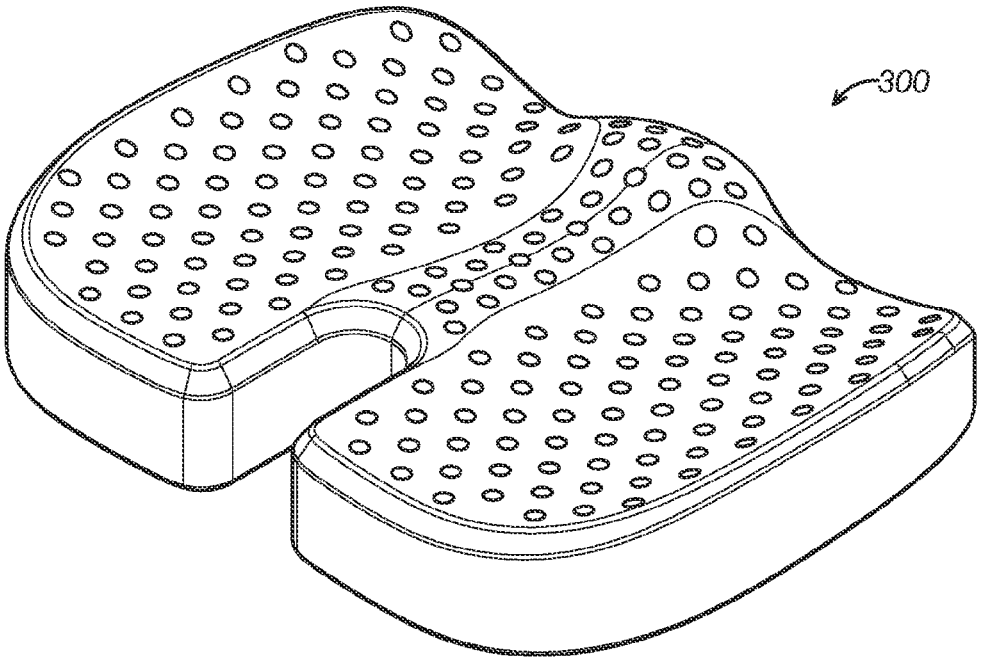
FIGS. 5A and 5B are perspective views of additional example improved foam seat cushions depicting alternative arrangements of channels.
Figure 5B:
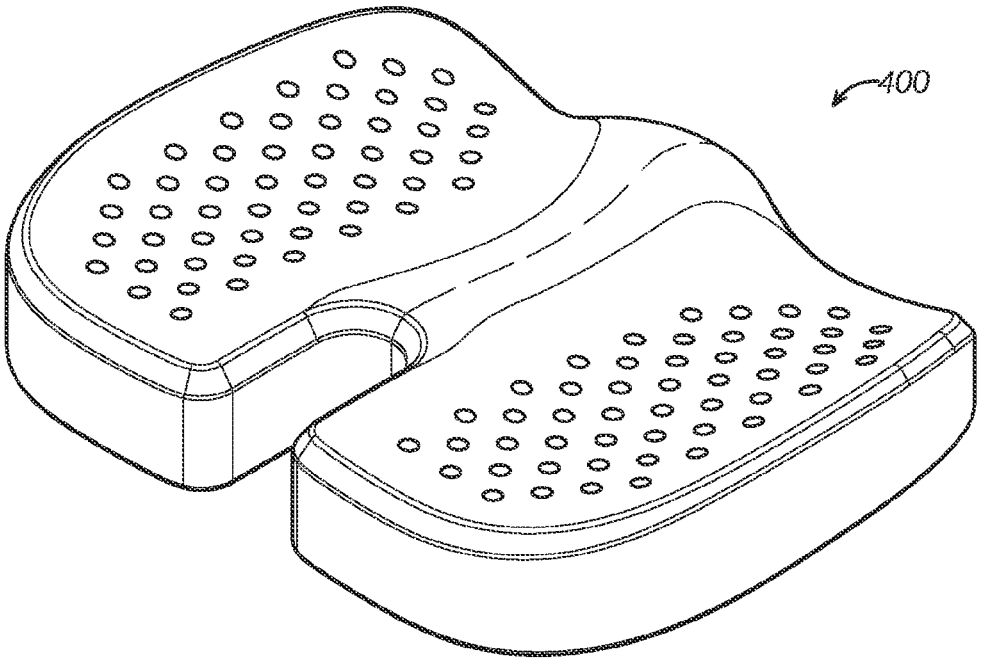

Turning to FIGS. 5A and 5B two examples of alternative arrangements of plurality of channels 114 are shown. In foam seat cushion 300, plurality of channels 114 are shown dispersed relatively evenly across the expanse of cushion 300. In contrast, foam seat cushion 400 shows plurality of channels 114 dispersed on the sides of cushion 400, in areas that are disposed proximate to each second side 110 and extend inward towards the center of foam seat cushion 400, but leave the center section proximate to and extending from notch 112 to opposite first side 108 without channels 114. A person skilled in the relevant art will understand that these are merely examples of possible arrangements of plurality of channels 114, and any number of possible arrangements beyond those disclosed herein are possible without departing from the disclosed invention.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and sub combinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A seat cushion, comprising:

an ergonomically shaped layer; and a cushioning layer disposed atop the ergonomically shaped layer, wherein:

the shaped layer and cushioning layer have a plurality of channels disposed across their surface that extend from the top of the cushioning layer through the bottom of the shaped layer, the shaped layer and cushioning layer have a notch that partially bisects the shaped layer and cushioning layer, thereby forming a channel that extends from the top of the cushioning layer through the bottom of the shaped layer, and the ergonomically shaped layer has at least one handle disposed upon it; and an air and moisture permeable, removable, form-fitting cover containing at least one compartment for enclosing the shaped layer and cushioning layer wherein the form-fitting cover contains a hole positioned so as to allow access to said handle.

2. The seat cushion of claim 1, wherein the ergonomically shaped layer further comprises two handles, with each handle affixed to opposing sides of the ergonomically shaped layer, and the form-fitting cover contains a second hole, each hole positioned to allow access to said two handles.

3. The seat cushion of claim 2, wherein the ergonomically shaped layer is at least partially bisected along an axis defined by the notch, and the opposing sides are substantially parallel to the axis.

4. A foam seat cushion, comprising:

a foam layer, possessing a top surface, a bottom surface, a first side, a second side, a third side opposing the second side, and a side opposing the first side that is scalloped in shape;

a cushioning layer disposed upon the top surface of the foam layer;

a notch disposed approximately in the middle of the first side, running between the cushioning layer, the top surface and bottom surface of the foam layer, and extending towards the center of the foam layer so as to partially bisect the foam layer;

a plurality of channels passing through the foam layer and cushioning layer, with openings on the cushioning layer, top surface and bottom surface;

a first handle attached to the second side;

a second handle attached to the third side; and an air and moisture permeable, removable, form-fitting cover containing at least one compartment for enclosing the foam layer and cushioning layers;

wherein:

the form-fitting cover contains a first hole and second hole, each positioned so as to allow access to the first handle and second handle, respectively; and the foam layer and cushioning layer are at least partially bisected along an axis that is defined by the notch, and extends from the notch to the center of the first front side that is scalloped in shape.

5. The foam seat cushion of claim 4, wherein the plurality of channels are distributed in a plurality of zones, each one of the plurality of zones being located adjacent to one of the second or third sides, so as to leave a central portion of the foam layer without channels.

6. The foam seat cushion of claim 4, wherein the plurality of channels are located in an area approximately in a center third portion of the foam layer, proximate to the notch.

7. The foam seat cushion of claim 4, wherein the foam layer is constructed of viscoelastic urethane foam.

8. The foam seat cushion of claim 7, wherein the cushioning layer is comprised of a gel-filled layer, and the plurality of channels extend through the cushioning layer.

9. The foam seat cushion of claim 4, wherein the foam layer and cushioning layer are fully bisected such that the foam layer and cushioning layer each have individual halves.

10. The foam seat cushion of claim 9, wherein the form-fitting cover that encloses the foam layer and the cushioning layer contains two compartments, where each compartment encloses each individual half of the fully bisected foam layer and cushioning layer, wherein the form-fitting cover keeps each individual half of the fully bisected foam layer and cushioning layer together.

11. The foam seat cushion of claim 4, wherein the top surface is ergonomically contoured.

12. The seat cushion of claim 1, wherein the notch meets the top of the cushioning layer at an angle between approximately 25 to 45 degrees.

13. The seat cushion of claim 1, wherein the plurality of channels are located in an area approximately in a center third portion of the shaped layer, proximate to the notch.

14. The seat cushion of claim 1, wherein the plurality of channels are distributed approximately evenly over the shaped layer.

15. The seat cushion of claim 14, wherein the cushioning layer is comprised of a gel-filled layer, and the plurality of channels extend through the cushioning layer.

16. The seat cushion of claim 1, wherein the shaped layer is constructed of viscoelastic urethane foam.

* * * * *